United States Patent [19]

Difflipp et al.

[11] Patent Number: 4,846,062

[45] Date of Patent: Jul. 11, 1989

[54] SHEET-TURNING DRUM IN SHEET-FED ROTARY PRINTING PRESSES

[75] Inventors: Kurt Difflipp; Dietzenbach/Steinberg; Heinrich Ochs, Oberzell, both of Fed. Rep. of Germany

[73] Assignee: M.A.N. Roland Druckmaschinen AG, Offenbach am Main, Fed. Rep. of Germany

[21] Appl. No.: 55,695

[22] Filed: May 29, 1987

[30] Foreign Application Priority Data

Apr. 29, 1986 [DE] Fed. Rep. of Germany ..... 3614565

[51] Int. Cl.[4] ..... B41F 21/10; B41L 21/06

[52] U.S. Cl. ..... 101/411; 101/420

[58] Field of Search ..... 101/216, 232, 246, 407 A, 101/408, 409, 410, 411, 420, 229, 231, 180

[56] References Cited

U.S. PATENT DOCUMENTS

| | | | |
|---|---|---|---|
| 4,111,123 | 9/1978 | Willeitner | 101/407 A |
| 4,227,459 | 10/1980 | Jeschke | 101/246 X |
| 4,377,112 | 3/1983 | Fischer | 101/246 |
| 4,535,691 | 8/1985 | Kida | 101/246 X |
| 4,580,494 | 4/1986 | Becher | 101/246 X |
| 4,668,925 | 9/1986 | Ailt | 101/420 X |
| 4,694,750 | 9/1987 | Greene | 101/420 X |

FOREIGN PATENT DOCUMENTS

| | | |
|---|---|---|
| 1891447 | 4/1964 | Fed. Rep. of Germany . |
| 2547251 | 10/1976 | Fed. Rep. of Germany . |
| 2604895 | 3/1978 | Fed. Rep. of Germany . |
| 433395 | 9/1967 | Switzerland . |

*Primary Examiner*—Edgar S. Burr
*Assistant Examiner*—James R. McDaniel
*Attorney, Agent, or Firm*—Leydig, Voit & Mayer

[57] ABSTRACT

A sheet-turning drum in a sheet-fed rotary printing press for optionally first printing or perfecting printing is provided that is simple to assemble and adapted to be changed over for differing printing requirements. To this end, the sheet-turning drum is subdivided into a unitary main member and a cylindrical drum envelope. The latter having a sheet support surface and flanges disposed on its end faces for securing the envelope between mounting flanges on the main member. The sheet support surfaces of the drum envelope can be in the form of a smooth metal surface, an ink-repellent fabric or support rollers retained on carrying rods.

4 Claims, 2 Drawing Sheets

SHEET-TURNING DRUM IN SHEET-FED ROTARY PRINTING PRESSES

FIELD OF THE INVENTION

The present invention relates to a sheet-turning drum in a sheet-fed rotary printing press for optionally first printing and perfecting printing.

BACKGROUND OF THE INVENTION

In printing presses of the above type, turning drums are needed in order to pick up the sheet from the previous storage drum either by way of the front edge or rear edge of the sheet, at choice, and to transfer the edge thus picked up as leading edge to a subsequent impression cylinder. Transmission elements and adjusting mechanisms are needed in addition to the gripper systems to perform the sheet pick-up and sheet transfer functions and to perform the very different movement patterns. The turning drum is usually formed with spaces to receive gripper systems and transmission elements and has a cylindrical sheet support surface operative to guide the sheets, such surface extending over more than half the periphery of the turning drum. Assembly and maintenance are therefore often fairly complex. However, precisely because the movement patterns are so complex, care must be taken to ensure that the drum surface, which of course always contacts the printed side of the sheet, does not damage the previous printing and that fresh ink is not deposited on the drum and does not cause uncontrolled soiling of subsequent sheets. This is particularly important when the press is operating with sheet turning and when the materials being printed are difficult —i.e., very thin or thick papers.

DE-AS 2 604 895 discloses a turning drum, describing a device for changing over gripper movement in association with a turning drum for first printing and perfector presses. This known drum has inter alia a pit receiving pins, a torsion bar spring interconnecting the same, an eccentric pin with eccentric projections and a slotted plate. These elements are operative to clamp, mount and displace driving elements with cam rollers to drive tong grippers, such rollers being opposite cams associated with the turning drum on both sides. To close the pit interrupting the sheet-guiding surface there is a longitudinally movable bridge which also carries the pins, torsion bar spring and eccentric pin. Guiding and clamping elements must therefore be provided on the drum in order to secure the position of the bridge and to facilitate movement thereof.

In the version of this drum disclosed by DE-AS 2 547 251 the pit is closed by means of a separate filing element in order to cover the drive parts below.

In both these solutions of the problem the sheet-guiding surface of the drum is made partly of the parent material and partly from the material used for the filling element or bridge. Irregularities may therefore readily arise on the drum surface. To obviate this, the parts must be made with a relatively high degree of precision and consequently expensive production in order to fit the bridge or filling element. Also, the presence of one of the covers described means that only a reduced proportion of the transmission elements in the drum is accessible. Because the drum itself is therefore of relatively complex construction, manufacture and assembly are costly. Also, the drum surface is adaptable to printing process requirements either not at all or only at considerable cost.

OBJECTS AND SUMMARY OF THE INVENTION

It is therefore the primary object of the invention to provide a sheet-turning drum whose construction facilitates assembly and servicing and whose surface is also adaptable to different printing requirements.

According to the present invention, the sheet-turning drum is subdivided into a unitary main member and a cylindrical drum envelope. The latter having a sheet support surface and flanges disposed on its end faces for securing the envelope between mounting flanges on the main member. The sheet support surface of the drum envelope can be in the form of a smooth metal surface, an ink-repellent fabric or support rollers retained on carrying rods.

A very advantageous feature is that the surface can be removed from the drum as a completely independent element. Consequently, transmission parts can be placed on the main member without being disturbed by other parts of the drum, the drum only then being made up completely with the envelope element. This provides many advantages in subsequent servicing of the drum since the transmission elements thereof are of course all subject to wear; the drum is in all considerably lighter than previously since it is largely hollow.

Another particular advantage of the drum according to the invention is that the surface can be adapted to required printing conditions. Since the drum is required to operate with different stocks it contacts the fresh printing of the previous printing unit at different pressures. This occurs more particularly in the printing of heavy card stock or board-like materials. It is very advantageous in such cases if a closed surface of the drum can be replaced by a surface having moving support rollers. Sheet support can then be adjusted to predetermined pressure-free zones. Also, an envelope element having a special coating and means to retain an ink-repellent fabric can be used for the drum outside surface. The associated envelope elements can very readily be interchanged with one another on the drum and make possible smear-free operation with different stocks and with print surfaces of different sensitivities.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENTS

Figure 1:
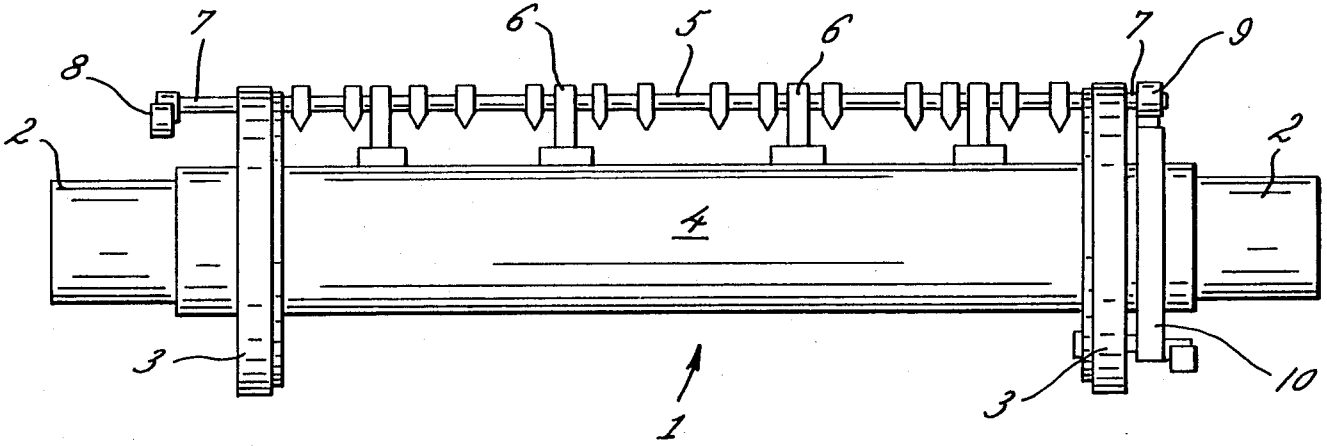
FIG. 1 is a view in longitudinal section through the main member of the turning drum with grippers and drive elements.

Turning now to the drawings, FIG. 1 shows main member 1 of a sheet-turning drum. The member 1 has end bearing journals 2, discoid flanges 3 in the form of solid cylinders and a central support member 4 in the form of a shaft. The main member 1 is preferably a unitary casting in which the journals 2, flanges 3 and assembly surfaces for the sheet-conveying elements are machined. Gripper shafts 5 are rotatably mounted on pedestals 6 disposed on the central member 4. The shafts 5 extend by way of their ends 7 through the flanges 3 and drive elements are secured to the shaft ends 7. The drive elements are cam-follower levers and gears 9 for controlling sheet transfer during sheet turning. The gears 9 are engaged by cam-controlled drive elements 10 also mounted in a flange 3. The construction of the shaft 5 and drive elements 6–10, being conventional, further details are not shown herein.

The control of the two gripper shafts 5 varies the timing and sequence of the sheet gripper openings according to whether the press is being used for first printing or perfecting printing. To this end, the levers 8 cooperate with a gripper-opening cam on the press frame, the latter cam being adjustable to suit the conditions of first printing or perfecting. The drive elements 10 for controlling the penetrating or dipping movement of the gripper shafts 5 in turning the rear edge of the sheet cooperate with a turning cam on the press frame, the latter cam being adapted to be brought into or out of operation. The mechanisms for adjusting the gripper-opening cam or for engaging and disengaging the turning cam with the elements 10 are disposed outside the zone of the drum.

Figure 2:
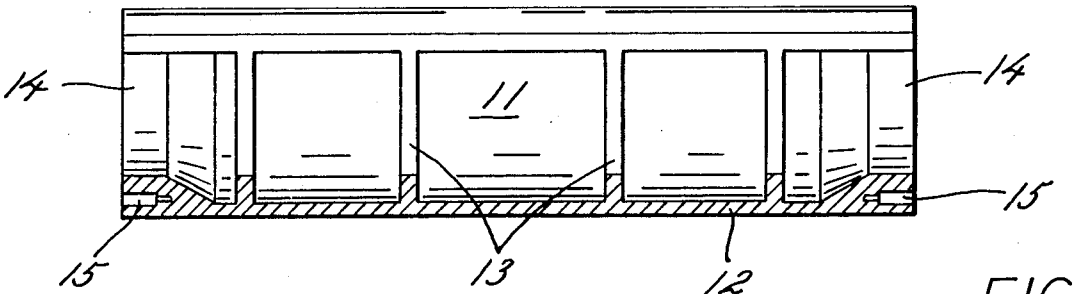
FIG. 2 is a longitudinal section through a drum envelope.

To complete the drum a sheet-guiding surface must be provided. A drum envelope 11 for this purpose is shown in longitudinal section in FIG. 2. The envelope 11 is a hollow cylindrical member having a smooth closed sheet support surface 12, preferably stiffened with ribs 13 on the inside of the envelope 11. Securing flanges 14 are provided on the end faces of the envelope 11 as part of a unitary casting, the securing flanges 14 being sickle-like thickenings on the axial ends of the envelope 11. The flanges 14 are formed with tapped securing bores 15.

Figure 3:
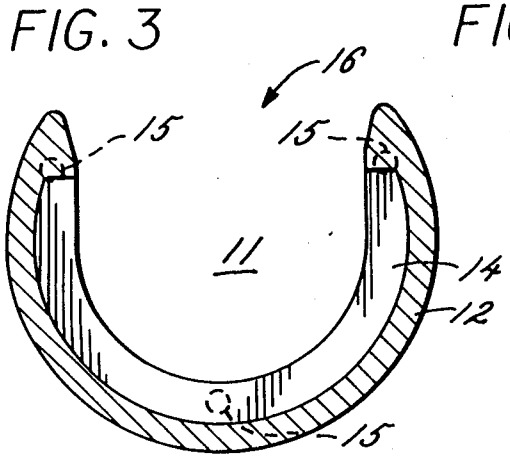
FIG. 3 is a cross-section through a smooth surfaced drum envelope.

An end view of one of the securing flanges 14 is shown in FIG. 3. As will be apparent, the envelope 11 is open on its end faces and axially along its outside surface. This envelope aperture 16 corresponds in a turning drum of solid construction to the pit for the gripper systems. The aperture 16 is so devised near the flanges 14 as to be adapted to be moved over the support member 4.

To assemble the envelope 11, it is pushed on to the main member 1 between the flanges 3, which are formed with retaining bores corresponding to the bores 15. The envelope 11 is secured to the flanges 3 just by screwing in appropriate bolts or cap screws. The envelope 11 can be demounted just as easily when it is required to work on the gripper systems.

Figure 4:
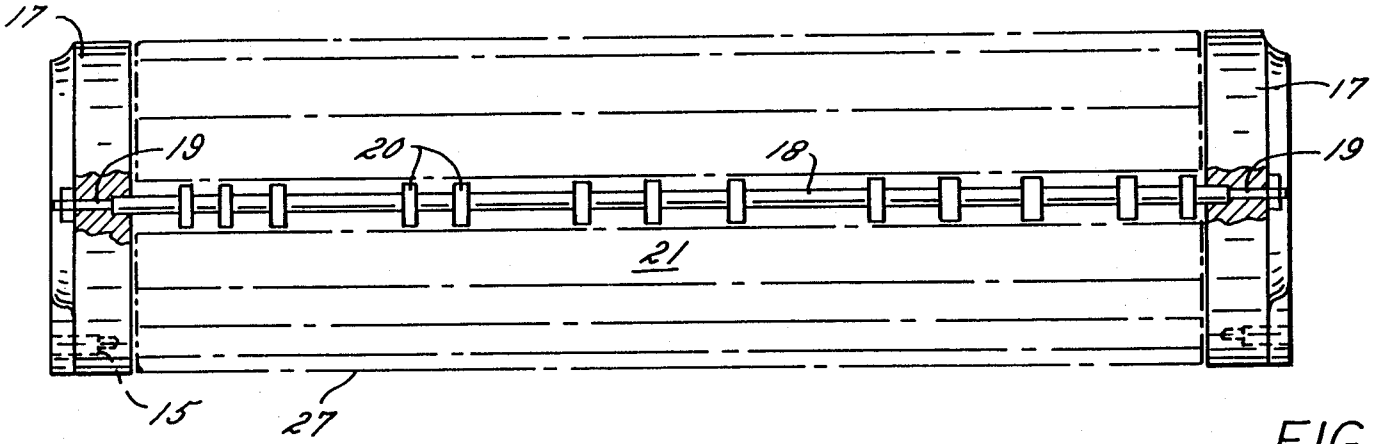
FIG. 4 is a longitudinal view of a drum envelope with support rollers.

Another drum envelope 21 having an alternative form of sheet support surface 27 is shown in FIG. 4. The envelope 21 in this construction is not a closed surface, but is a surface combined from dot-like mobile sheet support surfaces. To this end, securing flanges 17 are interconnected by carrying bars 18 which are screwed into retaining bores 19 in the flanges 17. Support rollers 20 which are free to rotate and which can be moved axially of the envelope 21 are disposed on the bars 18. The screwed connection between the bars 18 and the flanges 17 leads to a stable unit in the form of a roller drum envelope 21.

Figure 5:
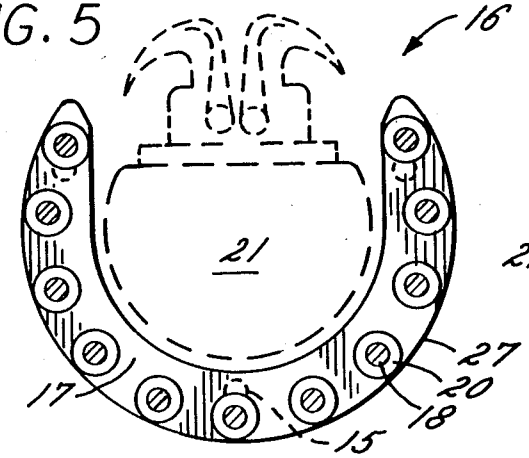
FIG. 5 is a cross-section through a drum envelope with rollers.

A cross-section of the envelope 21 is shown in FIG. 5. The flanges 17 are in their outer shape similar to the flanges 14 and are formed in a similar manner and with a similar distribution with securing bores 15. The drum 21 is formed with an envelope aperture 16. Consequently, it can be secured to the drum main member 1 in the same way as the envelope 11 by being pushed in and screwed to the flanges 3.

Figure 6:
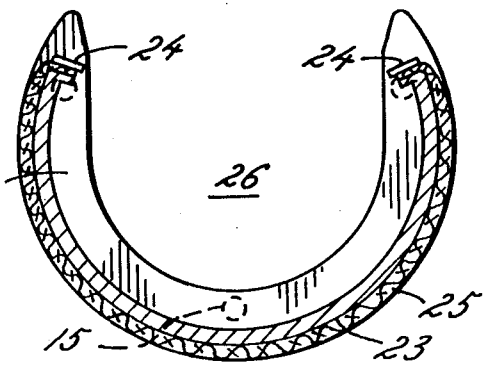
FIG. 6 is a cross-section through a drum envelope with a fabric covering.

FIG. 6 shows a third variant of the drum envelope. In this case the cross-section of a drum envelope is used to replace ink-repellent fabric. For example, the drum might be fitted with different fabric covers for different printing jobs. To this end, a sheet support surface 23 of smaller diameter than the corresponding sheet support surfaces of the envelope 11 and envelope 21 is disposed on the securing flange. The outside of the surface 23 preferably has a low-friction plastic coating. Clamps 24 are disposed at the ends of the surface 23 and are operative to clamp an ink-repellent fabric 25 thereto. The drum envelope 26 thus devised is assembled as described in the two embodiments referred to previously. Securing flanges 22 are formed with securing bores 15 registering with retaining bores in flanges 3 of main member 1 and adapted to have retaining screws screwed into them after the envelope 26 has been pushed in.

The assembly of these various envelopes 11, 21, 26 makes it possible to adapt the press to the use of a wide variety of paper stocks and to a wide variety of printing formats.

For example, the drum can be made ready as follows:

In normal conditions the envelope 11 with the closed surface 12 can deal adequately with medium-heavy papers and simple subjects. However, for thicker papers and irregularly distributed subjects it may be desirable to use the roller drum envelope 21, since the surface thereof is in the form of dot-like support zones which can be adjusted to different zones of the sheet being printed. Also, the envelope 26 can be used more particularly for relatively thin papers with complicated subjects. The risk of smearing in this case is very slight. Adaptation to stressing of the paper is automatic, an advantage for thin paper which must not be overstressed. However, this version is less suitable for relatively thick stocks since the surface is too resilient for them.

The embodiments described do not exhaust all the possibilities of the invention. Other surfaces and other kinds of securing are possible.

We claim as our invention:

1. A sheet-turning drum in a sheet-fed rotary printing press for optional first printing and perfecting printing, the drum being operative to remove a paper sheet by way of the front or rear edge thereof from a preceding storage drum, the turning drum being formed with a longitudinally extending, radially outwardly opening aperture to receive gripper systems and transmission elements and having a cylindrical sheet support surface operative to guide the sheets, and with the support surface extending over more than half the periphery of the turning drum, characterized in that: the turning drum is in the form of a main member of unitary construction, having bearing journals at its ends, each journal merging into a cylindrical discoid flange with a central support member extending between the flanges; the surface of the turning drum being in the form of a hollow cylindrical demountable envelope element partly open on its end faces and axially along its outside surface; and the envelope element having integral radially inwardly extending securing flanges adjacent its ends for securing it directly between the discoid flanges of the main member.

2. A drum according to claim 1, characterized in that the envelope element is a smooth hollow aluminum member with internal ribbing and the sheet support surface of the envelope element is a substantially U-shaped closed arcuate surface.

3. A drum according to claim 1, characterized in that the envelope element is in the form of a plurality of support bars which are disposed near the outside surface thereof and retained between said radially inwardly extending securing flanges adjacent the ends thereof, and a plurality of support rollers are rotatably mounted on the support bars.

4. A drum according to claim 1, characterized in that the envelope element is a hollow member coated with a sliding surface and having clamps for holding an ink-repellent fabric.

* * * * *